US005565901A

United States Patent [19]

Hawkins

[11] Patent Number: 5,565,901

[45] Date of Patent: Oct. 15, 1996

[54] SELF-ALIGNED FEATURES FOR ACCURATE ETCHED SILICON TRANSDUCER PLACEMENT

[75] Inventor: William G. Hawkins, Webster, N.Y.

[73] Assignee: Xerox Corporation, Stamford, Conn.

[21] Appl. No.: 337,495

[22] Filed: Nov. 8, 1994

[51] Int. Cl.[6] ..... B41J 2/05

[52] U.S. Cl. ..... 347/49; 347/67

[58] Field of Search ..... 347/19, 49, 50, 347/57, 59, 63, 65, 67, 60; 361/748, 760, 807, 809; 257/797

[56] References Cited

U.S. PATENT DOCUMENTS

| | | | |
|---|---|---|---|
| 4,350,448 | 9/1982 | Hanagata et al. | 347/49 |
| 4,463,359 | 7/1984 | Ayata et al. | 347/56 |
| 4,601,777 | 7/1986 | Hawkins et al. | 347/63 |
| 4,638,337 | 1/1987 | Torpey et al. | 347/65 |
| 5,000,811 | 3/1991 | Campanelli | 347/42 |
| 5,160,403 | 11/1992 | Fisher et al. | 347/42 |

FOREIGN PATENT DOCUMENTS

| | | | |
|---|---|---|---|
| 3059540 | 3/1988 | Japan | 347/49 |

*Primary Examiner*—Benjamin R. Fuller
*Assistant Examiner*—L. Anderson
*Attorney, Agent, or Firm*—Oliff & Berridge

[57] ABSTRACT

An ink jet module that can be accurately positioned on a carrier includes a channel die and a heater die. The channel die is rectangular and has a top surface, a bottom surface, a first pair of sides, and a second pair of sides. The bottom surface has a number of spaced parallel channels disposed within it. The channels are parallel to the first pair of sides and extend through one of the second pair of sides. The top surface of the heater die is attached to and aligned with the bottom surface of the channel die. At least one pair of alignment features is disposed within and adjacent a side of the bottom surface of the channel die. The alignment features are recessed areas disposed on opposite sides from each other. The alignment features are dimensioned to receive a retainer that secures the ink jet module to a carrier.

16 Claims, 4 Drawing Sheets

SELF-ALIGNED FEATURES FOR ACCURATE ETCHED SILICON TRANSDUCER PLACEMENT

BACKGROUND OF THE INVENTION

This invention relates to the accurate placement of microelectronic transducers, and more particularly, to providing alignment features for precisely locating an ink jet printhead for assembly and later use.

Thermal ink jet printers are well known as exemplified by U.S. Pat. Nos. 4,463,359 and 4,601,777. In the systems disclosed in these patents, a thermal ink jet printhead comprises one or more ink filled channels that communicate with a relatively small ink supply chamber at one end and have an opening (i.e., a nozzle) at the other end. An array of thermal energy generators, usually resistors, are located in the channels at a predetermined distance from the nozzle. The resistors are individually addressed with a current pulse to momentarily vaporize the ink and form an ink bubble that expels an ink droplet. As the bubble grows, the ink bulges from the nozzle and is contained by the surface tension of the ink in the form of a meniscus. Once the bubble begins to collapse, the ink remaining in the channel between the nozzle and bubble starts to flow toward the collapsing bubble, causing the volumetric contraction of the ink at the nozzle and resulting in the separating of the bulging ink as a droplet The acceleration of the ink out of the nozzle while the bubble is growing provides the momentum and velocity of the droplet in a substantially normal direction toward a recording medium (e.g., paper).

One value of ink jet marking is the ability of this technology to produce color images at low cost. Color ink jet printers use either a single multicolored printhead or multiple printheads that must be positioned accurately in the printer. Although single multicolored printheads are attractive because all the nozzles are aligned on one substrate, the productivity of such a single multicolored printhead is low. Multiple printhead color printers operate at considerably higher speeds, but they are more expensive, in part because of the need to align each of the printheads with respect to the others within the printer. The printheads in these multiple printhead printers can be either permanent, semipermanent or disposable. Since customers will replace semipermanent or disposable printheads, the installation of these printheads cannot be a complicated or difficult procedure. This invention is a solution to the fabrication problem associated with the manufacture of printheads that are accurately aligned within a multiple printhead printer.

Another situation where accurate printhead to printhead alignment is desirable is in productive, high performance printers. For these printers, multiple printheads of one color are frequently used to increase speed. Therefore, it is highly desirable to be able to place multiple printheads in such a productive printer accurately.

Printers that use thermal ink jet transducers typically feature either a printhead that moves with respect to paper or paper that moves with respect to a stationary printhead. The printhead in turn contains electrical circuitry, a mechanical location device, an ink supply, and an ink jet module. The ink jet module contains a plurality of heater elements with addressing circuitry, each associated with and located in the vicinity of an ink nozzle. The ink jet module is the portion of the printhead that actually fires the ink at the media. Most generally, the ink jet module includes a channel plate and a heater substrate. Ink jet modules can be of either the roof shooter type or side shooter type, as is well known in the art.

In one specific implementation, the ink jet module includes a laminated wafer pair. In this case, each ink jet module includes a heater die and a channel die that are aligned and bonded together. The heater die is a substantially flat substrate that contains a linear array of heating elements and addressing electrodes. The channel die is a substrate having at least one anisotropically-etched recess that serves as an ink supply manifold once the channel die is bonded to the heater die. A linear array of parallel grooves are formed in the channel die so that one end of each of the grooves communicates with the manifold recess, and the other end is open for use as an ink droplet expelling nozzle.

Many ink jet modules can be produced simultaneously by first configuring a number of sets of heating element arrays and addressing electrodes on a silicon wafer. A corresponding number of sets of channels and manifolds are then produced in a second wafer. Next, the two wafers are aligned according to sets of alignment markings that appear on each wafer. Finally, the wafers are bonded together and then diced to produce multiple ink jet modules. The separate ink jet modules are ultimately attached to a carrier or a support substrate (e.g., a heat sink) individually or in an array.

Each of the heating elements can also be located within a recess in the heater die. U.S. Pat. No. 4,638,337 issued to Torpey et al. discloses a heater die having recess walls that contain the heating elements and prevent lateral movement of bubbles through the nozzle to eliminate the sudden release of vaporized ink into the atmosphere (i.e., blow-out). If allowed to occur, blowout causes ingestion of air and interrupts printhead operation. To prevent blowout, a thick film organic polymer structure is interposed between the heater die and the channel die to contain the bubble formed over the heating elements and to direct the force of bubble expansion upward, thereby enabling the droplet velocity to increase.

Past efforts at aligning ink jet modules, e.g., as disclosed in U.S. Pat. No. 5,160,403 issued to Fisher and U.S. Pat. No. 5,000,811 issued to Campanelli, focused on aligning a number of ink jet modules with respect to each other in an array. The purpose of these inventions is to create large arrays of drop ejectors by assembling manageable modular subunits. In both of these patents, one side or surface of each ink jet module is modified to abut or connect to the next adjacent printhead ink jet module. Accordingly, the position of each ink jet module depends upon the position of the adjoining modules. In other words, neither patent discloses a device for independently and positively locating a single ink jet module on a carrier.

Aligning a single ink jet module on a carrier with sufficient accuracy is difficult. In certain applications, e.g., color desktop ink jet printing, the different color printhead ink jet modules must be aligned within 1 to 2 pixels, and preferably within ¼ to ½ pixel This corresponds to a distance of 10 to 40 micrometers. Since the sides of the ink jet module are irregular as a result of the dicing process, and because the heater die may vary in thickness, neither a side nor the bottom surface of the ink jet module can serve as a datum for locating the module on the carrier with this level of precision.

SUMMARY OF THE INVENTION

It is therefore an object of the invention to provide an ink jet module that can be accurately positioned as a single module on a carrier that in turn becomes pan of a printhead.

It is another object to provide a device that has positive locating features and is easy to install.

It is a further object to provide a device that achieves accurate color registration.

It is yet another object to provide a device that would positively locate a printhead without the use of automated vision equipment.

It is still another object to provide a device that would be economical to produce.

The present invention achieves these and other objects by providing alignment features and a corresponding retainer for use in initiable positioning the ink jet module and then permanently securing the module to a carrier. As disclosed, the present invention can be used in connection with single module applications or multiple module applications in which the ink jet modules are spaced from one another.

The channel die is rectangular and has a top surface, a bottom surface, a first pair of sides, and a second pair of sides. The bottom surface has a number of spaced parallel channels disposed within it. The channels are parallel to the first pair of sides and extend through one of the second pair of sides. The top surface of the heater die is attached to and aligned with the bottom surface of the channel die.

At least one pair of alignment features are disposed within and adjacent a side of the bottom surface of the channel die. The alignment features are recessed areas disposed on opposite sides from each other. In one embodiment, the recesses are formed in both the channel die and the heater die.

Each alignment feature is dimensioned to receive a boss that projects from a leg of a retainer. The bosses support and position the ink jet module within a predetermined degree of precision. The union of the boss and the alignment feature prevents movement in the horizontal, transverse, and vertical directions. The legs of the retainer are connected by a horizontal member. The retainer secures the module to the carrier at a predetermined location with respect to a datum.

BRIEF DESCRIPTION OF THE DRAWINGS

A complete understanding of the present invention may be obtained by reference to the accompanying drawings, when considered in conjunction with the subsequent detailed description thereof, in which.

FIGS. 2*a*-1 and 2*a*-2 depict top and side views, respectively, of the carrier or heat sink on which the ink jet module is fixedly mounted;

FIGS. 2*b*-1 and 2*b*-2 depict top and side views, respectively, of the carrier or heat sink with the ink jet module and retainer combined as a unit;

FIGS. 2*c*-1 and 2*c*-2 depict top and side views, respectively, of the carrier, circuit board, and ink jet module combined as a unit at an intermediate stage of manufacture;

DETAILED DESCRIPTION OF PREFERRED EMBODIMENTS

Figure 1:
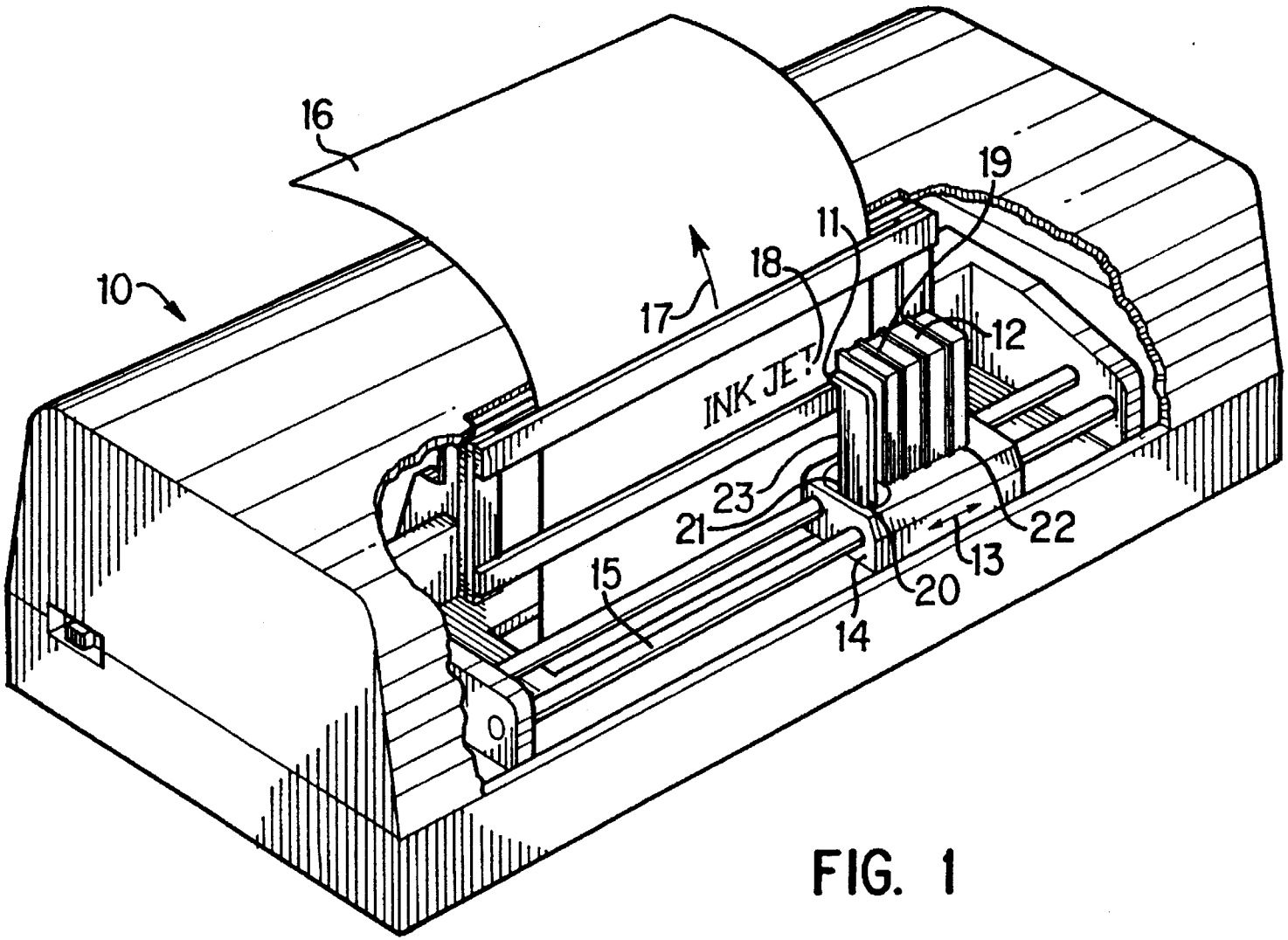
FIG. 1 is a schematic isometric view of a carriage type thermal ink jet printing system incorporating the present invention.

A typical carriage type, multi-color, thermal ink jet printing device 10 is shown in FIG. 1. A lineal array of ink droplet producing channels 27 (FIG. 4) is housed in each printhead 11 of each ink supply cartridge 12. One or more ink supply cartridges are replaceably mounted on a reciprocating carriage assembly 14, which translates back and forth in the direction of arrow 13 on guide rails 15. The channels terminate at a surface in a array of orifices or nozzles. The array of nozzles may be arranged in a single parallel row or in a small number of staggered rows, depending on details of ink jet module construction. The array of nozzles is perpendicularly aligned with the carriage reciprocating direction and parallel to the stepping direction of the recording medium 16. Thus, the printhead prints a swath of information on the stationary recording medium as it moves in one direction. Prior to the carriage and printhead reversing direction, the recording medium is stepped by the printing device a distance equal to the printed swath in the direction of arrow 17, and the printhead moves in the opposite direction to print another swath of information. Droplets 18 are expelled and propelled to the recording medium from the nozzles in response to digital data signals received by the printing device controller (not shown), which in turn selectively addresses the individual heating elements located in ink jet module channels at a predetermined distance from the nozzles. An electrical current pulse energizes a heater. The current pulses passing through the printhead heating elements vaporize the ink contacting the heating elements and produce temporary vapor bubbles to expel droplets of ink from the nozzles.

Figures 1, 2C:
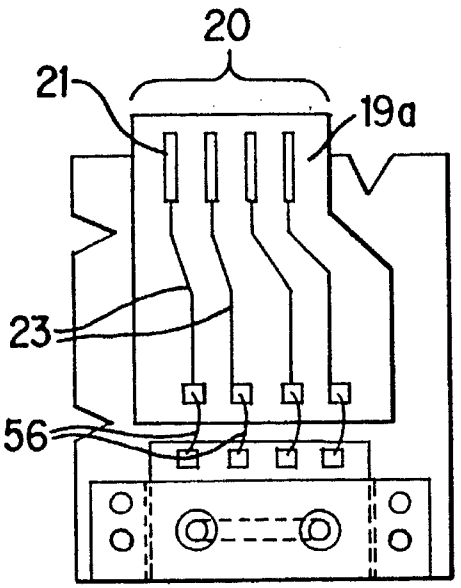
Figures 2, 2C:
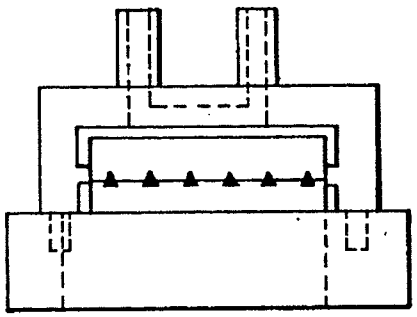
Figures 1, 2B:
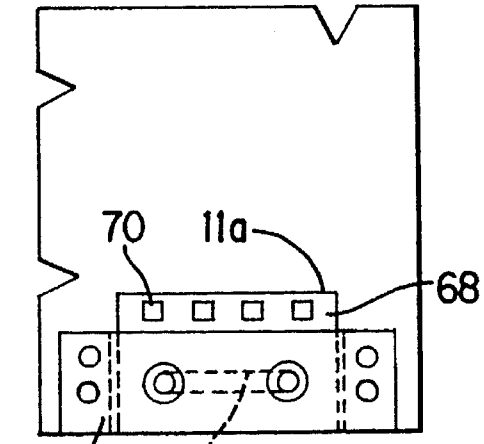
Figures 2, 2B:
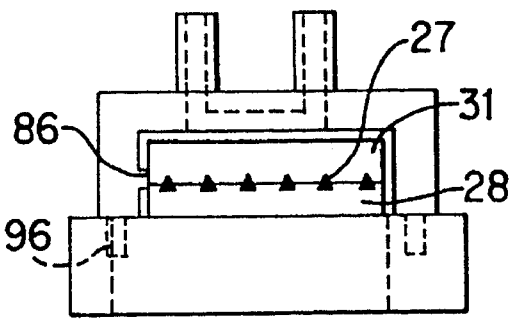
Figures 1, 2A:
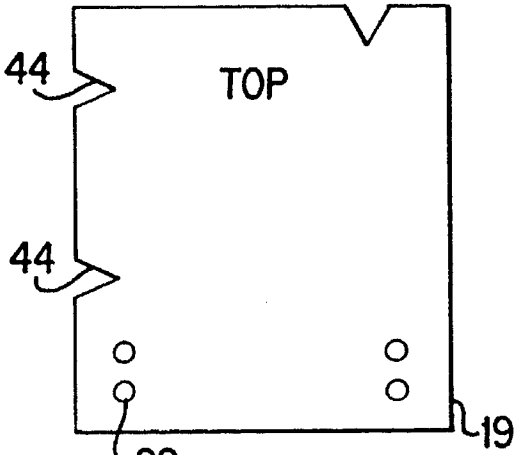
Figures 2, 2A:
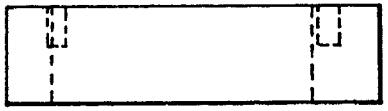

In FIG. 1, several ink supply cartridges 12 and fixedly mounted carriers 19 are shown. As shown in FIGS. 2*a*-1 and 2*a*-2, the carriers 19 have positioning features 44 that permit them to be precisely positioned in the printer. At least one ink jet module 11*a* (FIGS. 2*b*-1, 2*b*-2, 2*c*-1 and 2*c*-2) is permanently attached to each carrier 19. The printer is electrically connected to the ink et module 11a by a circuit board 19*a* (FIG. 2*c*-1). An ink jet module fill hole, as discussed in detail below, is sealingly positioned against and coincident with an aperture (not shown) in the ink supply cartridge, so that ink from the cartridge is continuously supplied to the ink channels via the manifold during operation of the printing device. In one preferred embodiment, the printhead ink jet module contains 48 channels on 3.3 mil centers for printing a resolution of 300 spots per inch (spi). The number of jets and the resolution, however, can be varied to achieve the desired number of pixels per inch and print swath.

A top view of the circuit board 19*a* that contains the ink jet module 11*a* is shown in FIG. 2*c*-1. The lower portion 20 of each circuit board 19*a* has electrode terminals 21 that extend below the cartridge bottom to facilitate plugging the carrier 19 into a female receptacle (not shown) in the carriage assembly 14. The circuit board 19a is bonded to the carrier 19 (FIGS. 2*c*-1 and 2*c*-2). The circuit board electrodes 23 correspond on a one-to-one basis with and are wire bonded to the electrodes of the ink jet module 11*a* (FIG. 2*c*-1). The wire bonds 56 are installed automatically by any standard wire-bonding machine, as is well known in the art. In addition, any of several well known interconnection techniques, e.g., tape automated bonding (TAB), can be used to connect the circuit board and ink jet module electrodes.

Figure 4C:
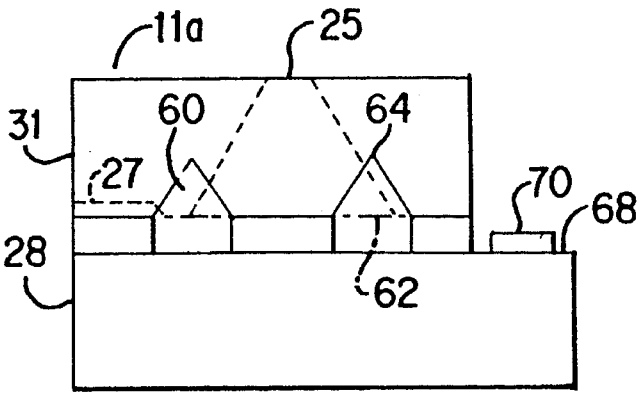
FIG. 4*a*, 4*b*, and 4*c* depict top, front, and side views, respectively, of the ink jet module showing alignment features according to a first embodiment of the present invention.
Figure 4A:
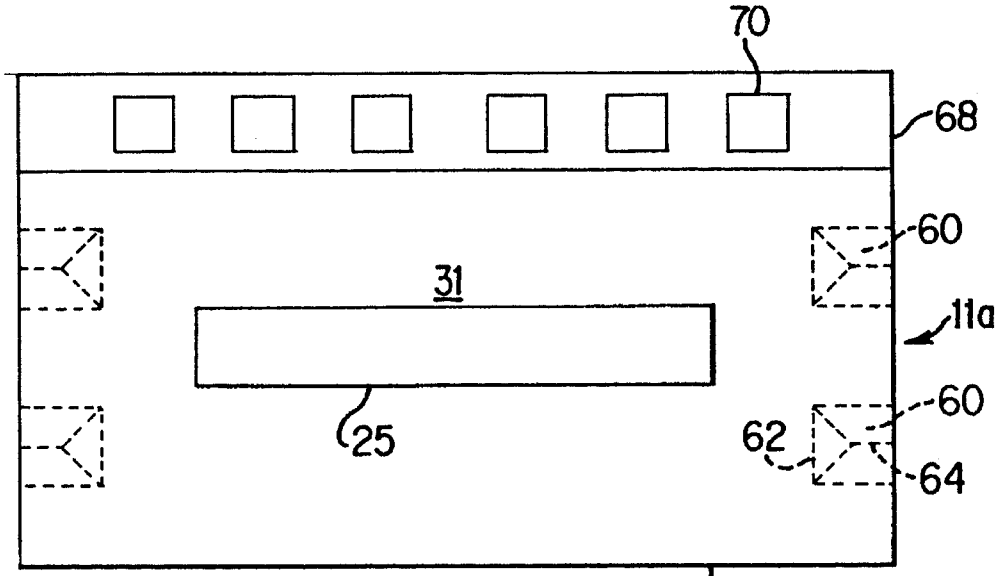
Figure 4B:
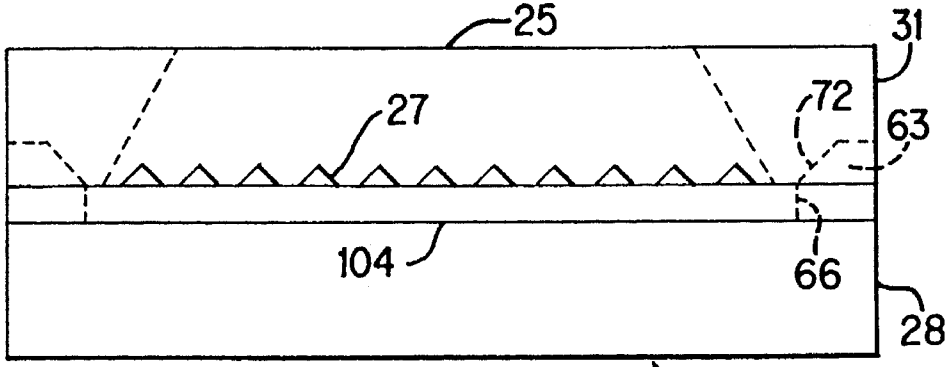

FIGS. 4*a*, 4*b*, and 4*c* depict top, front, and side views, respectively, of the ink jet module 11*a*. The ink jet module 11*a* is comprised of a rectangular-shaped channel die 31 bonded to a mating heater die 28. The heater die 28 contains the heating elements and the addressing electrodes (not shown). The rear portion of the heater die 28 extends beyond the channel die 31 and forms a shelf 68. An array of bonding pads 70 for establishing electrical connections is disposed along the length of the shelf 68.

The channel die 31 is fabricated from (100) silicon. The ink fill hole 25 preferably extends through the center of the top surface of the channel die 31 and connects with a series of droplet emitting nozzles disposed within an array of parallel channels 27. The channels 27 are formed within the bottom surface of the channel die. Each of the channels has a V-shaped cross section and preferably extends from the side of the ink fill hole 25 to the side surface of the channel die 31. The side through which the channels extend (the "front side") must remain free from protrusions or interruptions so that the front side may be sealingly engaged with the capping station and maintenance station of the printer (not shown).

At least one set of alignment features 60 is disposed along opposite side surfaces of the printhead ink jet module 11*a* at the junction of the channel die 31 and the heater die 28. The alignment features 60 are recesses that extend partially through the printhead ink jet module 11*a* without communicating with the ink fill hole 25 or the channels 27. The cross section of the alignment features 60 is generally V-shaped. In this specific embodiment, the V-shaped features are a consequence of orientation dependent etching or anisotropic etching of (100) silicon. In alternative embodiments, the channel structure could be made by either nickel or plastic injection molding. The alignment features are defined by a rear vertical surface 66 in the heater die 28, an angled rear surface 72 in the channel die, two vertical side surfaces 62 in the heater die 28, two angled side surfaces 65 in the channel die 31, and a bottom surface 64 in the heater die. In a preferred embodiment, the portion of each alignment feature 60 that is disposed within the channel die 31 is formed by the same anisotropic etching process used to create the ink fill hole 25 and the channels 27.

The portion of the alignment feature 60 disposed within the top surface of the heater die 28 (i.e., the square defined by the vertical side surfaces 62, the bottom surface 64, and the rear vertical surface 66), is formed in the polyimide layer 104. The properties of the polyimide layer 104 permit material to be removed by various methods that produce substantially vertical surfaces. The anisotropic etching process that is used to form, e.g., the channels 27, the ink fill hole 25, and the portion of the alignment feature 60 disposed within the channel die 31, however, results in angled surfaces according to a known manner.

Figure 3:
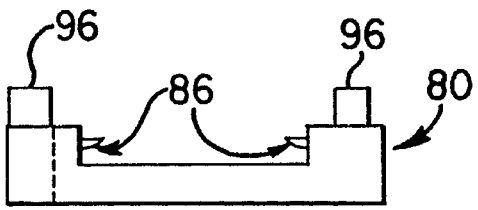
FIG. 3 depicts a front view of the retainer.
Figure 5A:
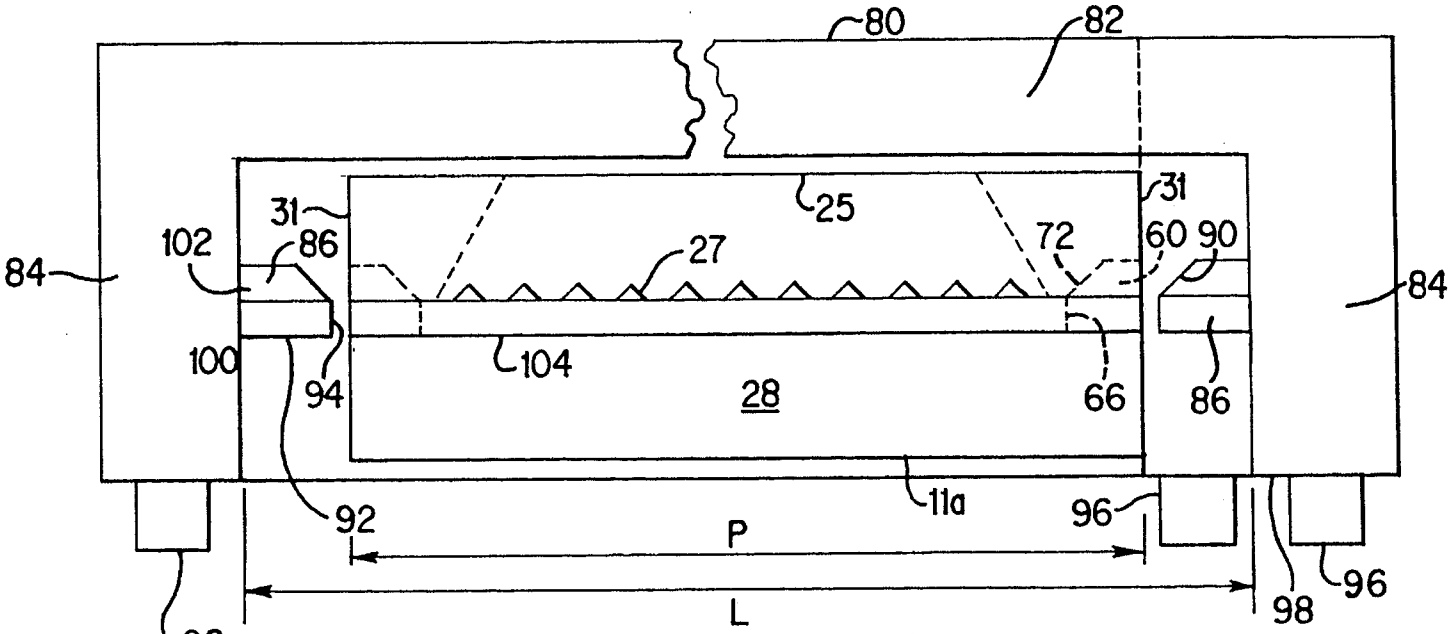
FIG. 5*a* depicts an inverted, expanded, and exploded view of FIG. 3*c*, showing the relationship of the retainer to the ink jet module before assembly.
Figure 5B:
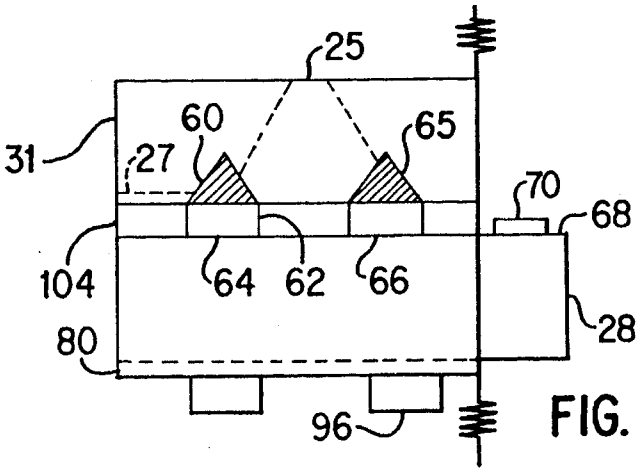
FIG. 5*b* depicts a side view of a portion of the assembled retainer and ink jet module.

FIG. 3 depicts a side view of the retainer 80 that positions the ink jet module 11*a* during assembly and secures it during use. FIG. 5*a* depicts an enlarged, exploded, and rotated view of FIG. 3 that includes the ink jet module 11*a*. FIG. 5*b* depicts a side view of FIG. 5*a* that shows a portion of the retainer 80 holding the ink jet module 11*a* in an assembled condition. The retainer 80 is substantially symmetrical, as viewed from the front side of the ink jet module 11*a*, and has a connecting member 82 disposed above the upper surface of the channel die 31. A leg 84 extends vertically downward from either end of the upper horizontal member 82. A pin 96 projects from a bottom surface 98 of either leg 84. The pins 96 are dimensioned to engage corresponding positioning features 99 in the carrier FIG. 2*a*-1. The open distance L between the legs is slightly greater than the length P of the ink jet module 11*a*. Bosses 86 project from either leg 84 inward toward the ink jet module 11*a*. Each boss 86 is dimensioned to removably engage a corresponding alignment feature 60. Each boss 86 is defined by an angled front surface 90, a vertical front surface 94, a horizontal bottom surface 92, two angled side surfaces 102 and two parallel side surfaces 100. Each of these surfaces corresponds with a similar surface of the alignment feature 60. In a preferred embodiment, the retainer 84 is fabricated from resilient material such as plastic.

According to the invention, the retainer 84 or the retainer 84/carrier 19 combination permits the ink jet module 11*a* to be positioned on the carrier 19 within the desired 1–2 pixel tolerance.

During assembly, the ink jet module 1 la is first positioned on the carrier near the desired position. The pin 94 of one leg 84 of the retainer 80 is inserted in one of the positioning features and the boss 86 is guided toward the alignment feature 60. As the boss 86 begins to engage the alignment feature 60, the upper horizontal member 82 becomes parallel with the top surface of the channel die 31. Without disengaging the pin 94 or the boss 86, the other leg 84 of the retainer 80 is then stretched to allow the insertion of the other boss 86 and pin 96 into the other alignment feature 60 and positioning feature, respectively. In an alternative embodiment, the horizontal member 82 of the retainer 80 further comprises an ink reservoir structure (not shown) that is aligned above the ink fill hole 25 after assembly.

As noted above, the opening L between the legs 84 is greater than the length of the printhead ink jet module P. Accordingly, a small gap exists between the inside surface of either leg 84 and the side surface of the ink jet module 11*a*. In other words, the ink jet module 11*a* is positioned in the horizontal direction according to the distance between the vertical front surface 94 of either boss 86. Neither side surface of the ink jet module 11*a* can serve as a datum because the dicing operation used to fabricate it results in irregularly shaped surfaces.

As shown in FIG. 5*a*, the boss 86 projects from the leg 84 at a height above the bottom surface 98 of the leg that is greater than the height of the heater die 28. In other words, the heater die 28 does not rest upon the carrier but is positioned in the vertical direction according to the height of the boss 86. Accordingly, a small gap between the bottom surface of the heater die 28 and the carrier is present after assembly. This gap accommodates variation in the height dimension of the heater die 28. The gap between the ink jet module and the carrier is filled with die bond adhesive.

The vertical surfaces of the portion of the alignment feature 60 disposed within the heater die 28 and the corresponding vertical surfaces of the boss 86 both serve an important function in the preferred embodiment. The vertical surfaces are the primary means for limiting the movement of the ink jet module 11*a* in the horizontal and transverse directions. If the boss 86 and the alignment feature 60 did not extend to include the vertically surfaced portion, the intersection of any one of the angled surfaces and its adjacent horizontal surface would resemble a wedge that, under force, would tend to separate the horizontal bond between the channel die 31 and the heater die 28. In the preferred embodiment, however, each angled surface intersects with a vertical surface and the vertical surfaces of the boss 86 abut the vertical surfaces of the alignment feature 60 such that no separation of the channel die 31 from the heater die 28 tends to occur.

Although the preceding description relates to the type of ink jet module 11*a* familiarly known as a "side shooter," the same concept can be embodied in a "roof shooter" printhead.

Since other modifications and changes varied to fit particular operating requirements will be apparent to those skilled in the art, the invention is not considered to be limited to the example chosen for the purpose of disclosure, and thus the invention covers all changes and modifications that do not constitute a departure from its true spirit and scope.

What is claimed is:

1. An ink jet printhead adapted for use in a marking device, comprising:

an ink containing channel plate having a first pair of sides, a second pair of sides, and a channel surface having at least one channel disposed therein;

a heater die having a top surface, said top surface being attached to said channel surface of said channel plate to form an ink jet module;

at least one set of alignment features disposed along at least two of said first pair and said second pair of sides approximately adjacent a function between said channel plate and said heater die; and a retainer disposed to engage said alignment features of said ink jet module, wherein said carrier is accurately positioned within said marking device.

2. The ink jet module according to claim 1, wherein said at least one channel is substantially parallel to at least one of said first pair of sides.

3. The ink jet module according to claim 2, wherein said alignment features are disposed along said second pair of sides.

4. The ink jet module according to claim 2, wherein said alignment features are disposed along said first pair of sides.

5. The ink jet module according to claim 1, wherein said alignment features are formed by etching.

6. The ink jet module according to claim 1, wherein said alignment features are formed by anisotropic etching.

7. The ink jet module according to claim 1, wherein said alignment features are recesses formed in at least one of said channel plate and said heater die having a V-shaped cross-section, said alignment features being distinct from said at least one channel.

8. The ink jet module according to claim 1, wherein said retainer is positioned within said printer within two pixels of a desired position.

9. The ink jet module of claim 1, wherein said marking device includes a carrier, and wherein said retainer engages said carrier such that said ink jet module is positioned within said marking device within two pixels of a desired position.

10. An ink jet printhead assembly, comprising:

a channel die, said channel die being substantially rectangular and having a top surface, a bottom surface, a first pair of sides, and a second pair of sides, said bottom surface having a plurality of spaced parallel channels disposed therein, said plurality of channels being substantially parallel to said first pair of sides;

a heater die having a top surface, the top surface of said heater die being attached to and aligned with the bottom surface of said channel die;

at least one set of alignment features disposed adjacent opposite sides of said bottom surface of said channel die and within said channel die and said heater die, said alignment features being recesses having open ends that define apertures; and a retainer, said retainer having at least one attached set of bosses dimensioned to removably engage the apertures defined by said recesses and said top surface of said heater die such that said retainer restricts said channel die and said heater die from moving.

11. The ink jet printhead assembly according to claim 10, wherein each of said opposing bosses extends from a leg of said retainer.

12. The ink jet printhead assembly according to claim 11, wherein said leg comprises a pin disposed to engage an aperture in a carrier.

13. An ink jet printhead assembly, comprising:

a channel die, said channel die being substantially rectangular and having a top surface, a bottom surface, a first pair of sides, and a second pair of sides, said bottom surface having a plurality of spaced parallel channels disposed therein, said plurality of channels being substantially parallel to said first pair of sides;

a heater die having a top surface, the top surface of said heater die being attached to and aligned with the bottom surface of said channel die;

at least one pair of alignment features positioned along said channel die and formed within said channel die and said heater die, each of said at least one pair of alignment features being opposite the other of said at least one pair of alignment features, said alignment features being recesses; and a retainer, said retainer having a horizontal connecting member and a leg extending vertically from each of said horizontal connecting member, said leg having a boss removably insertible in one of said alignment features and having a pin disposed to engage an aperture in a carrier disposed below said heater die, said boss engaging one of said alignment features such that said retainer restricts said carrier channel die and said heater die from moving.

14. A rectangular ink jet printhead module, comprising:

a channel die, said channel die being substantially rectangular and having a bottom surface, a first pair of sides, and a second pair of sides, said bottom surface having a plurality of spaced parallel channels disposed therein, said plurality of channels being substantially parallel to said first pair of sides and having at least one channel die recess disposed adjacent each of said first pair of sides;

a heater die having a top surface, the top surface of said heater die being attached to and aligned with the bottom surface of said channel die, said heater die having at least one heater die recess disposed in alignment with said at least one channel die recess;

at least one pair of alignment features disposed at a junction of said channel die and said heater die, each of said at least one pair of alignment features being an aperture defined by a periphery of said channel die recess and said heater die recess; and a retainer, said retainer having a horizontal connecting member and a leg extending vertically from each end thereof, said leg having a boss, said boss being removably inserted in one of said alignment features;

said leg having a pin disposed to engage an aperture in a carrier disposed below said heater die, wherein said boss is dimensioned to engage said alignment feature such that said retainer restricts said channel die and said heater die from moving.

15. An ink jet marking device having an ink jet printhead, said ink jet printhead comprising:

an ink containing channel plate having a first pair of sides, a second pair of sides, and a channel surface, said channel surface having at least one channel disposed therein, said at least one channel containing an ink ejection nozzle;

a heater die having a top surface, said top surface of said heater die being attached to said channel surface of said channel plate to form an ink jet module;

at least one set of alignment features disposed between said channel plate and said heater die; and a carrier disposed to fixedly receive said ink jet module, wherein said carrier is positioned within said printer.

16. A method of aligning an ink jet module comprised of a channel die having a plurality of spaced parallel channels bonded to a heater die on a carrier, the method comprising the steps of:

providing at least one set of alignment features in said ink jet module at a junction of said channel die and said heater die;

providing a retainer having legs extending from a connecting member, said legs having bosses dimensioned to engage said alignment features, said leg terminating in pins dimensioned to engage apertures in said carrier; and engaging said retainer with said ink jet module and said carrier such that said ink jet module is positioned within a printer.

* * * * *